US011641070B2

(12) United States Patent
Brooks

(10) Patent No.: US 11,641,070 B2
(45) Date of Patent: May 2, 2023

(54) AMPLIFIER FAST CONNECTOR

(71) Applicant: ALPS ALPINE CO., LTD., Tokyo (JP)

(72) Inventor: Eric Brooks, Jupiter, FL (US)

(73) Assignee: ALPS ALPINE CO., LTD., Tokyo (JP)

( * ) Notice: Subject to any disclaimer, the term of this patent is extended or adjusted under 35 U.S.C. 154(b) by 57 days.

(21) Appl. No.: 17/468,528

(22) Filed: Sep. 7, 2021

(65) Prior Publication Data

US 2023/0076116 A1 Mar. 9, 2023

(51) Int. Cl.
*H01R 4/48* (2006.01)
*H01R 4/50* (2006.01)

(52) U.S. Cl.
CPC ..... *H01R 4/489* (2013.01); *H01R 4/50* (2013.01); *H01R 4/5066* (2013.01)

(58) Field of Classification Search
CPC ..... H01R 4/489; H01R 4/5066; H01R 4/186; H01R 4/188; H01R 4/184; H01R 4/5075; H01R 4/5083
See application file for complete search history.

(56) References Cited

U.S. PATENT DOCUMENTS 5,083,947 A * 1/1992 Dominique ..... H01R 4/489 439/725
7,175,463 B2 * 2/2007 Burton ..... H01R 13/6395 439/346

FOREIGN PATENT DOCUMENTS

WO WO-2011001411 A1 * 1/2011 ..... F21S 4/22

* cited by examiner

*Primary Examiner* — Oscar C Jimenez
*Assistant Examiner* — Paul D Baillargeon
(74) *Attorney, Agent, or Firm* — Knobbe, Martens, Olson & Bear, LLP

(57) ABSTRACT

An amplifier connector including a housing having a first end with an aperture for receiving a bare cable end into a rib-receiving space between a pair of inner jaw members. The jaw members can be clamped on the cable end by moving a sliding sleeve with a wedge from an unlocked configuration to a locked configuration. A second end of the connector includes electrical contacts coupled with the pair of jaw members.

25 Claims, 8 Drawing Sheets

AMPLIFIER FAST CONNECTOR

BACKGROUND

Field

This disclosure generally relates to devices and systems for connecting power, signal, or other types of cables with an electronic device, such as an amplifier.

Related Art

An electronic signal amplifier, such as those used for home or vehicle audio systems, generally includes one or more connectors for electrically connecting the amplifier with speakers, signal sources, power or other peripheral devices. The connectors can facilitate connection between bare wires or cables and one or more ports within the amplifier.

SUMMARY

According to a first aspect, an amplifier fast connector includes a housing with a first portion and a second portion. The first portion includes a first opening within the housing. The first opening provides access to a positive terminal. The positive terminal includes a first movable jaw member, first fixed jaw member, and a first wire-receiving space between the first movable jaw member and the first fixed jaw member. The first movable jaw member is biased away from the first fixed jaw member by a first elastic member. A second opening within the housing provides access to a negative terminal. The negative terminal includes a second movable jaw member. A second fixed jaw member. and a second wire-receiving space between the second movable jaw member and the second fixed jaw member. The second movable jaw member is biased away from the second fixed jaw member by a second elastic member. The second portion includes a positive contact conductively coupled with the positive terminal, and a negative contact conductively coupled with the negative terminal. The positive contact includes an outer cylindrical portion protruding from the housing and coaxially mounted about an inner cylindrical portion of the negative contact. The inner cylindrical portion protrudes from the housing.

A locking sleeve is slideably disposed about the housing and is movable in a first direction relative to the housing from an unlocked position to a locked position. The locking sleeve includes a slide member, a first wedge coupled with the slide member with a first ramp surface aligned with the first movable jaw member in the first direction, and a second wedge coupled with the slide member with a second ramp surface aligned with the second movable jaw member in the first direction. A locking mechanism includes a catch member on the housing and a slot on the locking sleeve. The slot receives the catch member.

In a first configuration, the locking sleeve is in an unlocked position and the first and second movable jaw members are open to each allow a cable end to be received through the respective first and second openings and into the respective first and second wire-receiving spaces. In a second configuration, the locking sleeve is in a locked position with the catch member coupled within the slot. The first wedge engages with the first movable jaw member to close the first wire-receiving space, and the second wedge engages with the second movable jaw member to close the second wire-receiving space such that the cable ends are retained within the respective positive and negative terminals.

According to another aspect, a connector includes a housing with a first portion. The first portion includes a first opening and a second opening within the housing. A positive terminal within the first opening includes first and second paired jaw members with a first wire-receiving space therebetween. A negative terminal within the second opening includes third and fourth paired jaw members with a second wire-receiving space therebetween. A locking sleeve couples with the housing. In a first configuration. the first and second jaw members of the positive terminal are open to receive a first cable end within the first wire-receiving space and the third and fourth jaw members of the negative terminal are open to receive a second cable end within the second wire-receiving space. In a second configuration, the locking sleeve is in a locked position. The locking sleeve engaged with at least one of the first and second jaw members to close the first and second jaw members about the first cable end. The locking sleeve engages with at least one of the third and fourth jaw members to close the third and fourth jaw members about the second cable end such that the first and second cable ends are retained within the respective positive and negative terminals.

According to another aspect, the first jaw member is a movable jaw member. According to another aspect, the second jaw member is a fixed jaw member. According to another aspect, the movable jaw member is pivotable about a first pin. According to another aspect, the movable jaw member is movable about a compliant portion thereof. According to another aspect, the movable jaw member is biased away from the second jaw member in an open configuration. The movable jaw member is coupled with a spring member. According to another aspect, the locking sleeve includes a first wedge and a second wedge. According to another aspect, in the locked position, the first wedge of the locking sleeve is engaged with the movable jaw member to close the first and second jaw members about the first cable end. The second wedge of the locking sleeve is engaged with the at least one of the third and fourth jaw members to close the third and fourth jaw members about the second cable end. According to another aspect, the first and second wedges are independently actuatable. According to another aspect, the first wedge includes a first ramp surface aligned with the movable jaw member in a first direction. The locking sleeve moves from an unlocked position to the locked position in the first direction. In another aspect, the first ramp surface has an angled profile. In another aspect, the first ramp surface has a stepped profile. According to another aspect, the first jaw member and the second jaw member include a plurality of teeth.

In another aspect, a locking mechanism fixes the locking sleeve in the locked position relative to the housing. In another aspect, the locking mechanism includes a projection and an aperture. The aperture receives the projection such that in the second configuration the locking sleeve is in the locked position with the projection coupled within the aperture. According to another aspect, the projection is on the housing and the aperture is on the locking member. According to another aspect, the locking member includes a slide member. The first and second wedges are positioned on the slide member. According to another aspect, the housing includes a second portion. The second portion includes a positive contact conductively coupled with the positive terminal and a negative contact conductively coupled with the negative terminal. According to another aspect, the positive contact includes an outer cylindrical portion protruding from the housing and is coaxially mounted about an inner cylindrical portion of the negative contact. According to another aspect, the first wire-receiving space includes an inner transverse profile. According to another aspect, the inner transverse profile is cylindrical. In another aspect, the inner transverse profile includes one or more transverse teeth extending into the first wire-receiving space. In another aspect, the inner transverse profile includes one or more circumferential teeth extending into the first wire-receiving space. In another aspect, the inner transverse profile is uniform from a front end to a second end of the first wire-receiving space.

The foregoing summary is illustrative only and is not intended to be limiting. Other aspects, features, and advantages of the systems, devices, and methods and/or other subject matter described in this application will become apparent in the teachings set forth below. The summary is provided to introduce a selection of some of the concepts of this disclosure. The summary is not intended to identify key or essential features of any subject matter described herein.

BRIEF DESCRIPTION OF THE DRAWINGS

Various examples are depicted in the accompanying drawings for illustrative purposes, and should in no way be interpreted as limiting the scope of the examples. Various features of different disclosed examples can be combined to form additional examples, which are part of this disclosure.

DETAILED DESCRIPTION

The various features and advantages of the systems, devices, and methods of the technology described herein will become more fully apparent from the following description of the examples illustrated in the figures. These examples are intended to illustrate the principles of this disclosure, and this disclosure should not be limited to merely the illustrated examples. The features of the illustrated examples can be modified, combined, removed, and/or substituted as will be apparent to those of ordinary skill in the art upon consideration of the principles disclosed herein.

Traditional cable connectors used with amplifiers are used to connect two or more cables with a port on the amplifier. Traditional cable connectors also generally include screw terminals for providing a secure connection with the bare ends of power or signal cables. The screw terminals generally include a slot or aperture into which a bare end (e.g., having a portion of the sheath removed) of a cable is received. Each of the receiving slots can include a screw member. Once the bare end of the cable is installed within the slot, the screw member can be tightened against the bare end to secure the cable within the slot. This solution provides a secure connection between the cable and the connector and has been used reliably in the past. However, assembly of this type of screw connection can be time consuming, especially during an installation process (e.g., for a home or vehicle sound system) that requires assembly of multiple connectors. Screw terminal connectors also require the use of a tool, such as a screw driver or Allen wrench. Commonly, the amplifier itself is packaged with such a tool to ensure that the user has the required tool on hand during installation of the amplifier. Accordingly, the present disclosure is directed to an improved amplifier connector. The improved amplifier connector can be assembled without the use of tools, which also providing a secure attachment with the cable ends.

Figure 1:
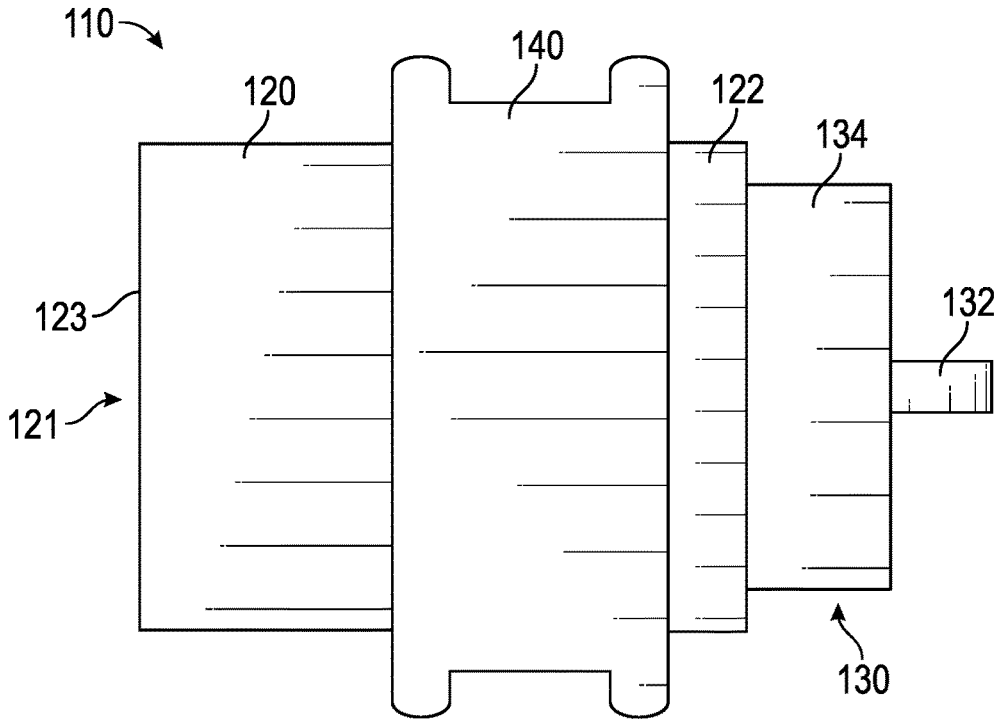
FIG. 1 shows a side view of an amplifier connector including a locking member.
Figure 2:
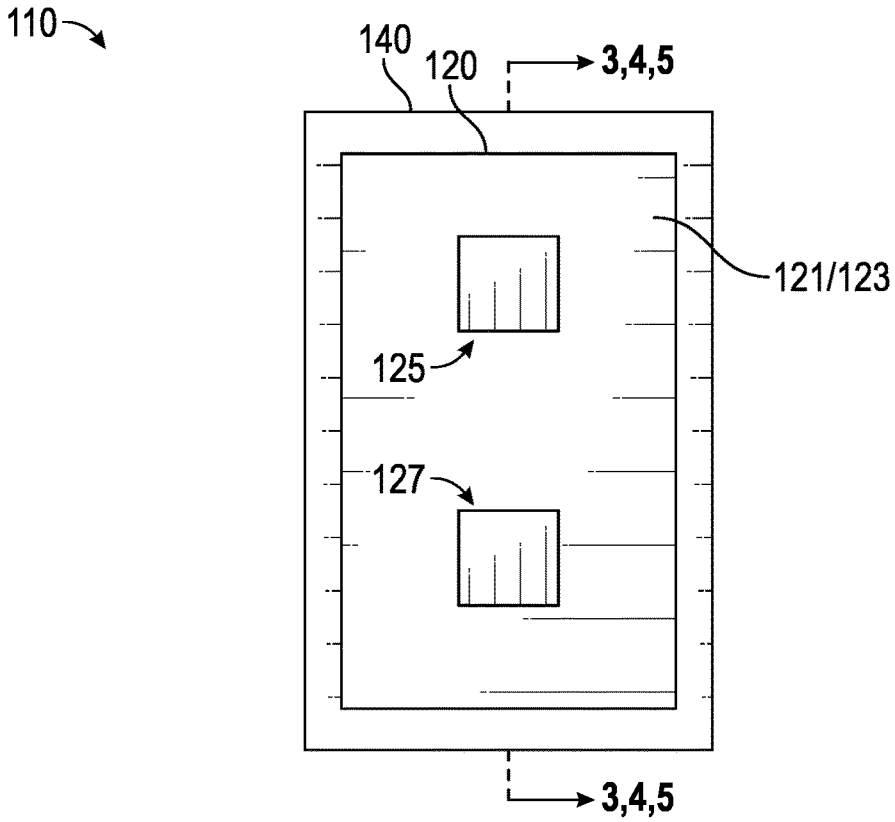
FIG. 2 shows a front view of the amplifier connector.

FIGS. 1-2 illustrate an amplifier fast connector 110. The connector 110 can include an outer housing 120. The outer housing 120 can comprise an insulative material such as a plastic, silicone, or rubber. The outer housing 120 can encapsulate an interior space containing various inner components of the connector 110, as described further below. The housing 120 can have an outer profile comprising various shapes.

The outer housing 120 can include a first end 121 and a second end 122. The first end 121 can include an end wall 123. The end wall 123 can be a planar wall or comprise one or more contours. The second end 122 can include positive and negative terminals in the form of an electrical plug, socket, or jack 130. The jack 130 can be on an opposite side of the housing 120 as the first end 121. The jack 130 can include one or more electrical contacts for forming a conductive connection with an amplifier or other electronic device. The jack 130 can include a coaxial connector with an inner contact 132 and an outer contact 134. The inner contact 132 can be a post coaxially mounted within a cylindrical member of the outer contact 134.

The outer housing 120 can include one or more apertures in an interior portion of the housing 120. The apertures can have include an outer profile having any desirable shape, such as round or rectangular (as illustrated). The one or more apertures can include a first aperture 125 and a second aperture 127. The apertures 125, 127 can be positioned on the end wall 123.

Figure 3:
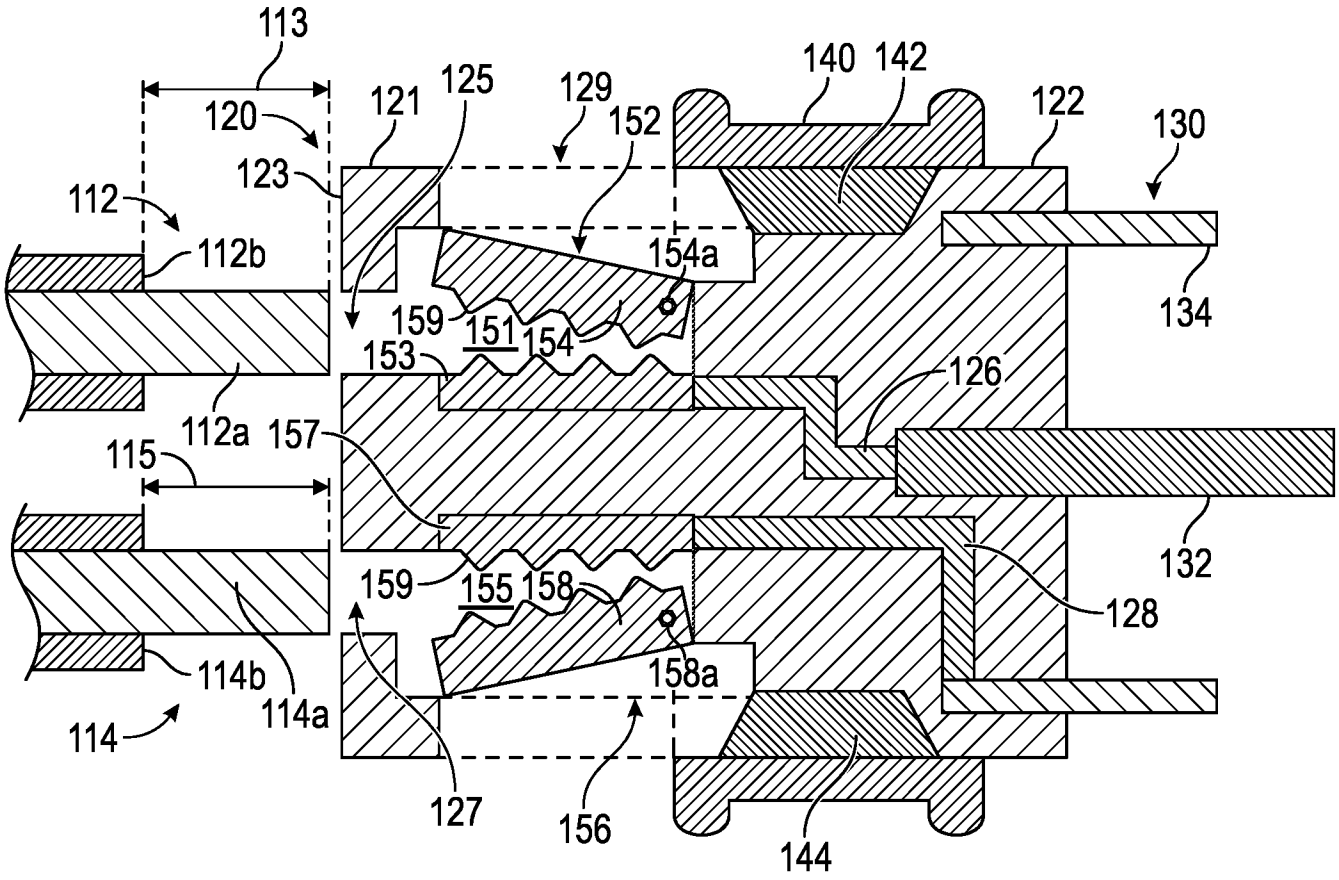
FIG. 3 shows a cross section of the amplifier connector in an unlocked configuration and further including two cables.
Figure 4:
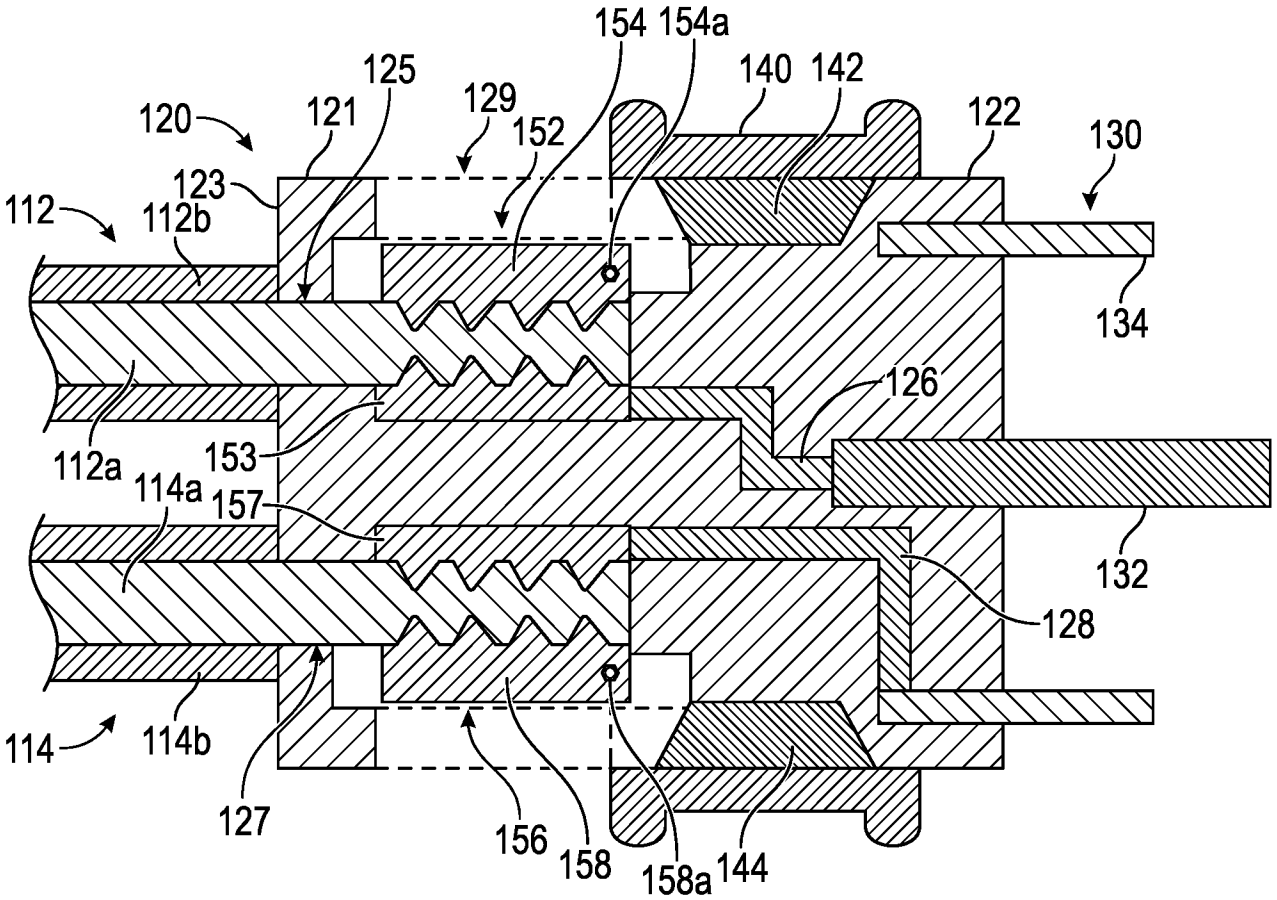
FIG. 4 shows a cross section of the amplifier connector in the unlocked configuration with the two cables received within respective pairs of jaw members.
Figure 5:
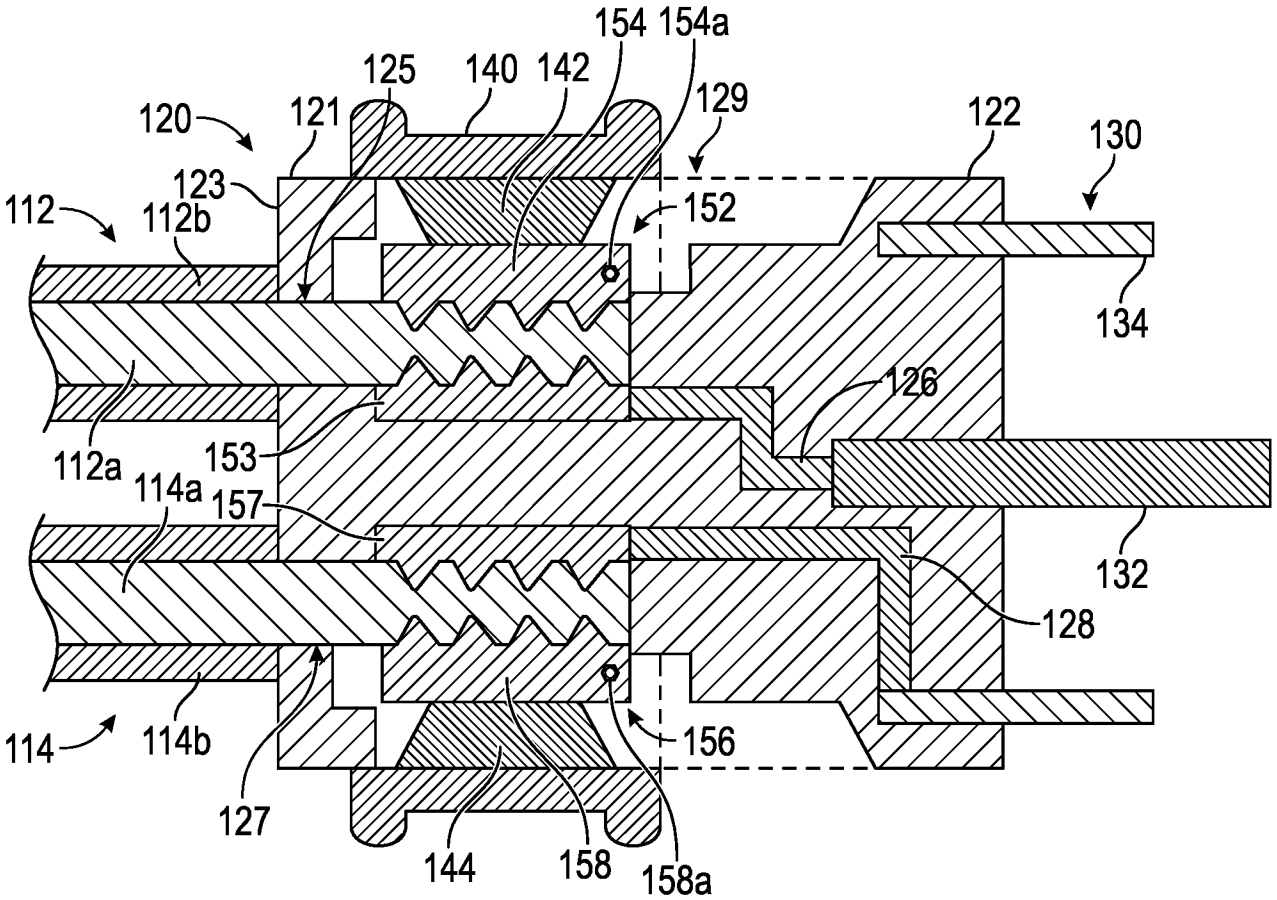
FIG. 5 shows a cross section of the amplifier connector in a locked configuration.

The connector 110 can include a locking member 140. The locking member 140 can be a sleeve disposed about an outer periphery of the housing 120. The sleeve can be fully or partially disposed about the circumference of the housing 120. The locking member 140 can be slidable in relation to the housing 120. As shown in the cross-section of FIG. 3-5, the locking member 140 can be movable along the housing 120 between a locked configuration (FIG. 5) and an unlocked configuration (FIGS. 3-4).

The housing 120 can include one or more grooves or slots within which a portion of the locking member 140 can be inserted. The grooves or slots can include slot 129. The locking member 140 can be movable along the slot 129. The locking member 140 can be coupled with the housing 120 within the slot 129. The sliding motion can be along a single direction, such as along or parallel with a longitudinal axis of the housing 120.

The locking member 140 can include one or more internal wedges or protrusions. The wedges can be located within the slot 129. The wedges can be trapezoid shaped. The wedges can include a frontward-facing side and an inward facing side. The frontward-facing side can be angled or ramped relative to the direction of travel of the locking member 140 along the slot 129. The inward facing side can be parallel with the direction of travel. The wedges can be movable along with the locking member 140 between the locked and unlocked configurations. The wedges can include a first wedge 142 and a second wedge 144.

The housing 120 can include positive and negative terminals. The housing 120 can include one or more pinching members, trapping members, or jaw members as the positive or negative terminals. The jaw members can be located within the housing 120 and aligned with a respective one of the apertures. A first pair of jaw members 152 can be aligned with the first aperture 125 as a first terminal. A second pair of jaw members 156 can be aligned with the second aperture 127 as a second terminal.

The first pair of jaw members 152 can include a fixed member 153 and a movable member 154. The movable member 154 can be aligned with respect to the fixed member 153 about a wire-receiving space 151. The jaw members 152 can be in the first end 121. The wire-receiving space 151 can be aligned with the first aperture 125.

A cable 112 can include a conductor 112*a* and an insulator 112*b*. The wire-receiving space 151 can be sized to receive a bare end 113 of the cable 112. A length and diameter (e.g., height and width) of the wire-receiving space 151 (and the jaw members 152) can be sized to receive the bare end 113 of the cable having a corresponding length (e.g., between 3-10 mm or 7 mm) and diameter (e.g., between 10 and 28 gauge).

The movable jaw member 154 can be movable relative to the fixed jaw member 153. The movable jaw member 154 can be coupled on a pin 154*a*. The pin 154*a* can be positioned on an opposite side of the movable jaw member 154 from the aperture 125. The movable jaw member 154 can be biased away from the fixed jaw member 153. The movable jaw member 154 can include an elastic member or spring. The movable jaw member 154 can be biased away from the fixed jaw member in a manner that provides access into the wire-receiving space 151 in the unlocked configuration of the locking member 140.

One or both of the fixed member 153 and the movable member 154 can include one or more grooves or teeth, such as teeth 159. The teeth 159 can extend inwardly towards the wire receiving space 151. The teeth 159 can extend transversely to an insertion direction of the bare cable end 113 through the aperture 125 into the wire-receiving space 151. In the locked configuration, the teeth 159 can engage with the bare cable end to prevent removal of the bare cable end from the wire-receiving space 151. Alternatively, the jaw members 152 include only a single, movable jaw member. In another alternative, both of the jaw members can be movable. The teeth 159 can be dull or sharp with the serrations or other friction-enhancing surfaces for engagement with the cable end 113. In certain implementations the teeth 159 can mesh with teeth on the opposite jaw member. Alternatively the teeth 159 can be aligned with opposing teeth on the opposite jaw member. The teeth 159 can comprise rubber, glass, plastic, metal or other conductive material or insulative material. The teeth 159 can extend into the wire-receiving space 151.

The jaw members 152 can be electrically coupled with the jack 130. One or both of the jaw members 152 can include a conductive material. The conductive material can be a metal (e.g., copper) plate fixed within jaw members 152 and positioned to face the wire-receiving space 151 and contact the bare end. The conductive material can be on the teeth 159 or another portion of the jaw members 152. The conductive material can be connected with an electrical conduit path 126. The electrical conduct path 126 can extend within the interior portion of the housing 120. The electrical conduct path 126 can connect with the jack 130 of the connector 110, such as the inner contact 132.

The second pair of jaw members 156 can include a fixed member 157 and a movable member 158. The movable member 158 can be aligned with respect to the fixed member 157 about a wire-receiving space 155. The jaw members 156 can be in the first end 121. The wire-receiving space 155 can be aligned with the second aperture 127. A second cable 114 can include a conductor 114*a* and an insulator 114*b*. The wire-receiving space 155 can be sized to receive a bare end 115 of the cable 114.

The movable jaw member 158 can be movable relative to the fixed jaw member 157. The movable jaw member 158 can be coupled on a pin 158*a*. The pin 158*a* can be positioned on an opposite side of the movable jaw member 158 from the aperture 127. The movable jaw member 158 can be biased away from the fixed jaw member 157. The movable jaw member 158 can include an elastic member or spring. The movable jaw member 158 can be biased away from the fixed jaw member in a manner that provides access into the wire-receiving space 151 in the unlocked configuration of the locking member 140. One or both of the fixed member 157 and the movable member 158 can include one or more grooves or teeth, such as teeth 159.

The jaw members 156 can be electrically coupled with the jack 130. One or both of the jaw members 156 can include a conductive material. The conductive material can be connected with an electrical conduit path 128. The electrical conduct path 128 can connect with the jack 130 of the connector 110, such as the outer contact 134.

The wedges of the locking member 140 can be aligned with respective pairs of jaw members. The movable jaw members can extend into the slot 129 in the unlocked configuration. In the locked configuration, the wedges of the locking member 140 can engage with the jaw members to force the movable jaw members towards the fixed jaw members or otherwise to close the wire-receiving spaces about the respective cable ends. In the locked configuration, the movable jaw members can be held in the closed configuration by inward facing sides of the wedges.

The frontward-facing side of the wedge member 142 can include a ramped surface. The ramped surface can engage with the movable jaw member 154 when the locking sleeve is moved in a first direction (from the unlocked configuration towards the locked configuration). The ramp surface of the wedge 142 can engage with an upper surface or corresponding ramp surface of the movable jaw member 154. Continued sliding of the wedge 142 into the locked configuration can securely shut the movable jaw member 154 in relation to the fixed jaw member 153. Similarly, the wedge 144 can shut or actuate the jaw member 158 of the jaw members 156.

Alternatively, the wedges 142, 144 can be independently actuatable between the unlocked and locked configurations. The locking member 140 can include individually movable components or parts on which the wedges are mounted. Accordingly, the wedges can be used to secure and close pairs of locking members independently. This can facilitate a piece-meal assembly of the cables 112, 114 within the connector 110 (e.g., one at time).

FIGS. 6A-6F illustrate various potential profiles for the wedges of a locking member 240, like the locking member 140. In each of the locking members 240, any number of wedges can be included, such as one, two, or more wedges. In addition, the wedges can be oriented in various locations or positions to correspond to the jaws of the connector 110. As illustrated the wedges of the locking members 240 are facing inwardly towards each other from the connection point with the locking member 240.

Figure 6A:
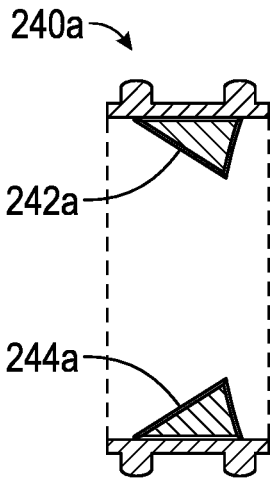
FIG. 6A shows another arrangement for the locking member.
Figure 6B:
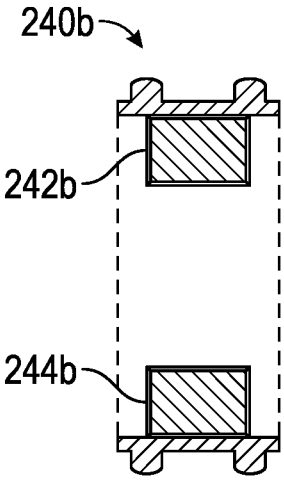
FIG. 6B shows another arrangement for the locking member.
Figure 6C:
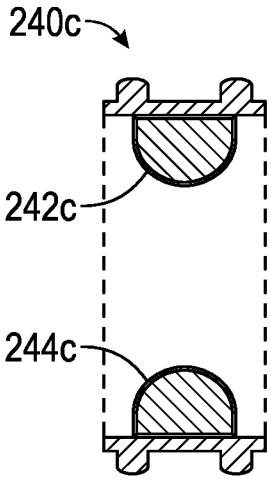
FIG. 6C shows another arrangement for the locking member.
Figure 6D:
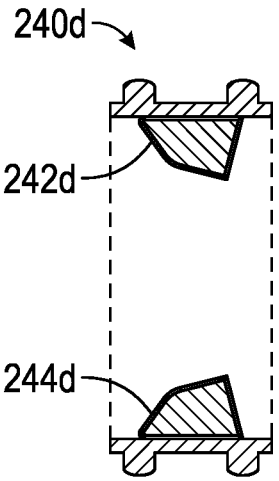
FIG. 6D shows another arrangement for the locking member.
Figure 6E:
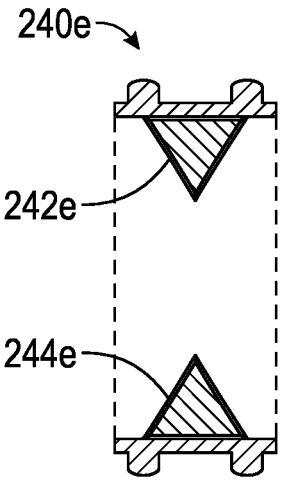
FIG. 6E shows another arrangement for the locking member.
Figure 6F:
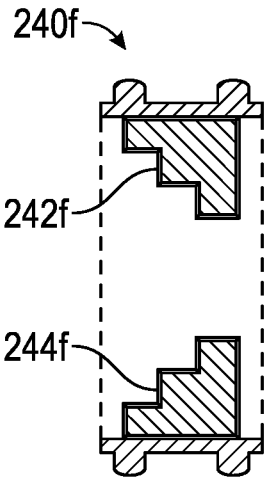
FIG. 6F shows another arrangement for the locking member.

FIG. 6A shows a first pair of wedges 242*a* in the locking member 240*a*. The wedges 242*a* can include a forwardly angled ramp surface in the form of a triangular profile. The angled incline can be approximately within between 90° and 0° and preferably between 15° and 85° and more preferably between 30° and 60°. FIG. 6B shows wedges 242*b* in a locking member 240*b*. The wedges 242*b* have a rectangular profile surface being at approximately 90° with respect to the central axis of the locking member 240*b*. FIG. 6C includes locking wedges 242*c* of the locking member 240*c*. The locking wedges 242*c* can include a ramped surface generally in the shape of a semicircle or hemisphere. In FIG. 6D, the wedges 242*d*, 244*d* can include a ramped surface having a faceted profile in the locking member 240*d*. The faceted profile can alternatively be a convex curved profile. FIG. 6E shows wedges 242*e* in a locking member 240*e*. The wedges 242*e* can include a ramp surface in the shape of an equilateral triangular member. FIG. 6F shows wedges 242*f* in the locking member 240*f* The ramp surface in the wedges 242*f* can include a stepped surface including a plurality of steps.

Figure 7B:
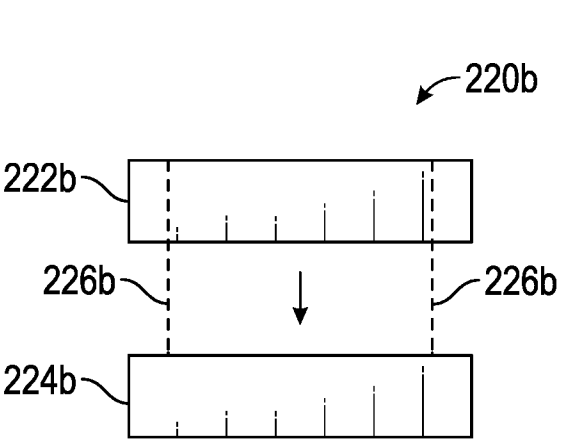
FIG. 7B shows another arrangement for a pair of jaw members.
Figure 7D:
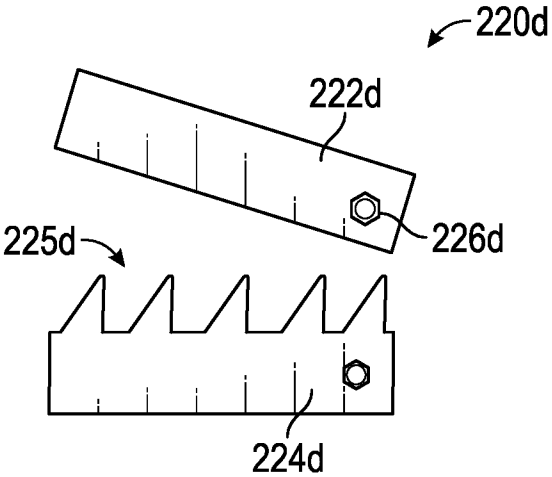
FIG. 7D shows another arrangement for a pair of jaw members.
Figure 7A:
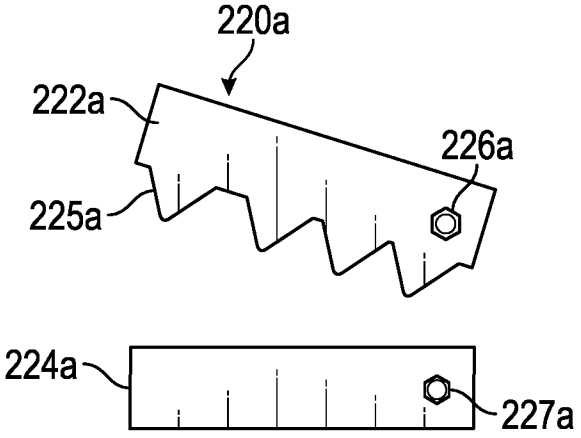
FIG. 7A shows another arrangement for a pair of jaw members.

FIGS. 7A-7D show various embodiments of jaw members, like the jaw members 152, 156 for use within the connector 110. The jaw members can each include one or a pair of jaws where one or both of the jaw members are movable with respect to a housing and/or each other. FIG. 7A shows a pair of jaw members 220*a*. The jaw members 220*a* can include a first movable jaw member 224*a* and a second movable jaw 222*a*. The first movable jaw member 224*a* can be mounted on a pivot 227*a*. The second movable jaw member 222*a* can be mounted on a pivot 226*a*. The pivots 226*a*, 227*a* can comprise an axle or other pivot point for the jaw member 220*a*. The one or both of the jaw members 222*a*, 224*a* can include one or more teeth 225*a*.

FIG. 7B shows a pair of jaws 220*b*, including a movable jaw member 222*b* and a fixed jaw member 224*b*. The movable jaw member 222*b* can be mounted along a pair of sliders 226*b*. Movement of the locking member can slide the movable jaw member 222*b* along the sliders 226*b* to secure on the bare cable ends.

Figure 7C:
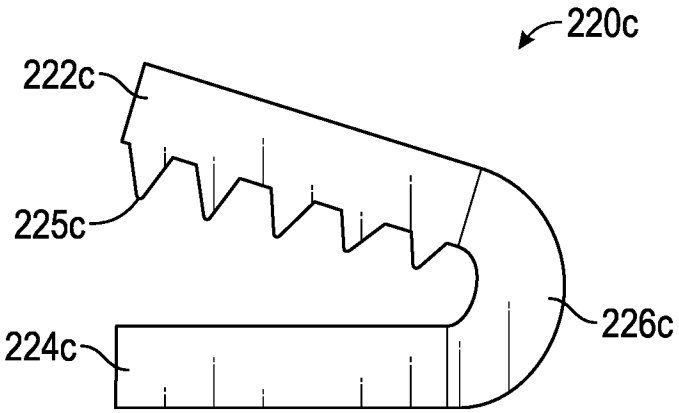
FIG. 7C shows another arrangement for a pair of jaw members.

FIG. 7C shows another pair of jaw members 220*c* including a fixed jaw 224*c* and a movable jaw 222*c*. The movable jaw 222*c* can be coupled with the jaw 224*c* via an elastic member 226*c*. The elastic member 226*c* can be a portion of material of the jaws 222*c*, 224*c* or an elastic material attached thereto. The elastic material 226*c* can bias the movable jaw 222*c* away from the fixed jaw 224*c*. The elastic material 226*c* can be formed out of a metal, rubber, or plastic material or other type of material. One or both of the jaw members 220*c* can include teeth 225*c*.

FIG. 7D shows another pair of jaws 220*d*, including a movable jaw 222*d* and a fixed jaw 224*d*. The movable jaw 222*d* is movable and pivotable about a pin 226*d*. A plurality of teeth 225*d* can be disposed on the fixed jaw 224*d*, but not on the movable jaw 222*d*. One or both of the jaw members 220*d* can include teeth 225*d*.

FIGS. 8A-8D show various embodiments of inner transverse profiles of the jaw members that define the rib-receiving space. The inner transverse profiles can define the wire-receiving space between each of the jaw members of any of the jaw members described above. In certain implementations, the inner profiles of each of the jaw members can extend from a first end (such that the front end of the jaw members) to a rear end (such as an inner end of the jaw members). The inner profiles can be uniform from the first to the second end of the jaw members.

Figure 8A:
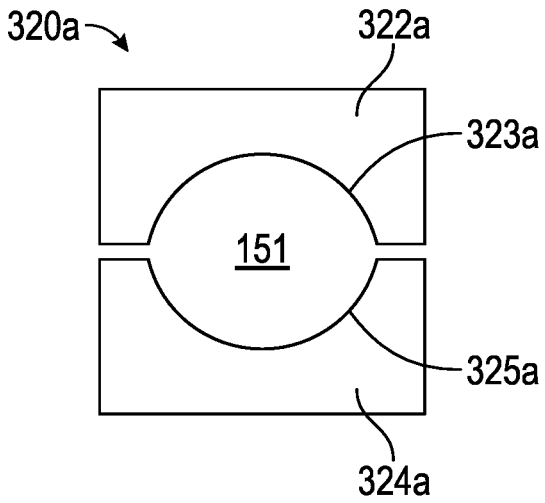
FIG. 8A shows a transverse cross-sectional profile for another arrangement of a pair of jaw members.

FIG. 8A shows a transverse cross sectional profile showing a pair of jaw members 320*a* in a closed position, including a jaw 322*a* and a jaw 324*a*. The jaw 322*a* can include a first inner profile 323*a*. The first inner profile 323*a* can be concave include a curvature. The jaw 324*a* can a similar inner transverse profile 325*a*. Together the inner profiles 323*a*, 325*a* can define the wire-receiving space.

Figure 8B:
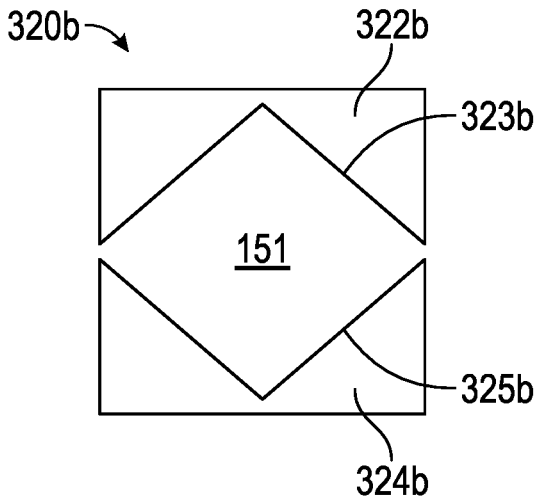
FIG. 8B shows a transverse cross-sectional profile for another arrangement of a pair of jaw members.

FIG. 8B shows the pair of jaws 320*b* including jaw member 322*b*, and jaw member 324*b*. Jaw member 322*b* can include an inner profile 323*b*. The inner profile 323*b* can comprise a concave profile with one or more straight segments. Here, the two straight segments are aligned at a 90° angle. Similarly, the jaw 324*b* can include a concave inner profile 325*b* formed of one or more straight lines. The concave inner profile 325*b* can include lines that are at 90°. Together the inner profile 323*b* and the inner profile 325*b* can form an enclosed space in the shape of a rectangle or square. Together the inner profiles 323*b*, 325*b* can define the wire-receiving space.

Figure 8C:
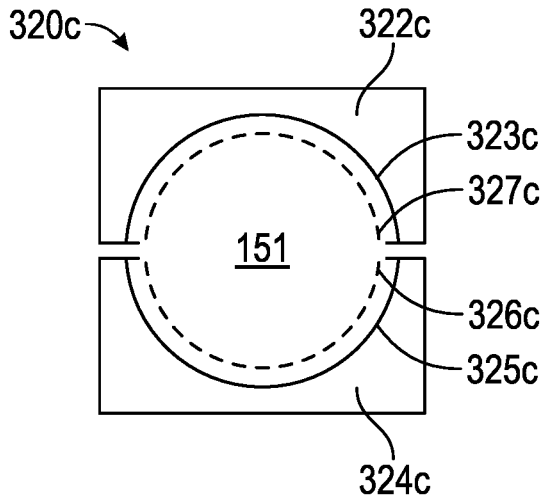
FIG. 8C shows a transverse cross-sectional profile for another arrangement of a pair of jaw members.

FIG. 8C shows the jaw members 320*c*, including jaw member 322*c* and jaw member 324*c*. The jaw member 322*c* can include a first inner profile 323*c* and a second inner profile 327*c*. The first and second profiles 323*c* and 327*c* can alternate and be offset from each other in an axial direction (e.g., in and out of the page shown in FIG. 8C). The pattern of the second inner profile 327*c* can be an inner circumferential tooth portion of the inner profile. The second inner profile 326*c* can include one or more of the inwardly extending portions (e.g., alternating with the first inner profile 323*c*). The second inner profile 327*c* can be curved. It can be curved the same as the first inner profile 323*c*. Similarly, the jaw member 324*c* can include a first inner profile 325*c* and a second inner profile 326*c*.

Figure 8D:
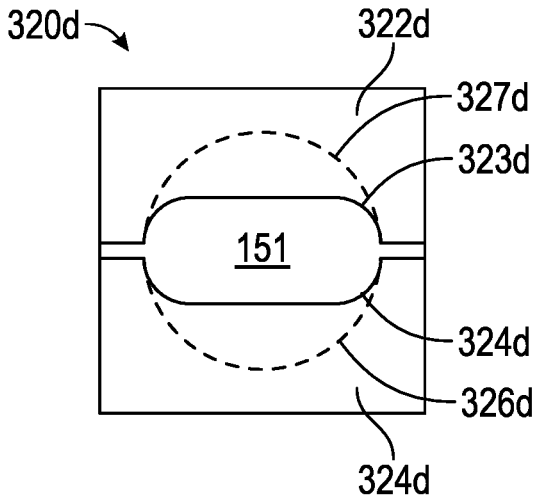
FIG. 8D shows a transverse cross-sectional profile for another arrangement of a pair of jaw members.

FIG. 8D shows the jaw members 320*d*, including jaw member 322*d* and jaw member 324*d*. The jaw member 322*d* can include a first inner profile 323*d* and a second inner profile 327*d*. The first and second profiles 323*d* and 327*d* can alternate and be offset from each other in an axial direction (e.g., in and out of the page shown in FIG. 8D). The pattern of the first inner profile 323*d* can be an inner circumferential curve. The pattern of the second inner profile 327*d* can be an inner horizontal tooth portion of the inner profile. The second inner profile 327*d* can include one or more of the inwardly extending portions (e.g., alternating with the first inner profile 323*d*). Similarly, the jaw member 324*d* can include a first inner profile 325*d* and a second inner profile 326*d*.

Figure 9A:
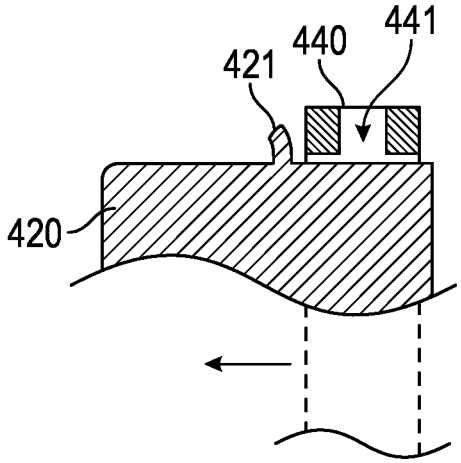
FIG. 9A shows a locking mechanism for securing the locking member in an unlocked configuration
Figure 9B:
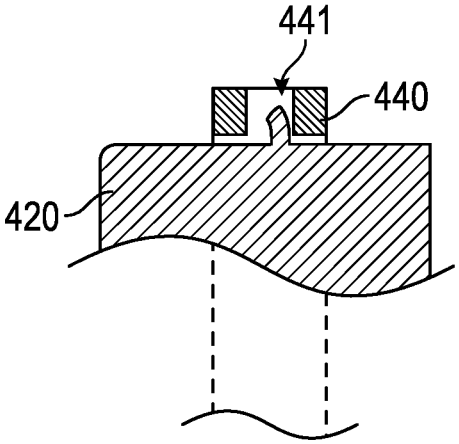
FIG. 9B shows the locking mechanism shown in FIG. 9A in a locked configuration.

FIGS. 9A and 9B show a first implementation of a locking mechanism for securing a locking member 440, like the member 140, with respect to a housing 420, like the housing 120. The housing 420 can include a protrusion 421. The protrusion 421 may be a curved or projecting member extending outwardly from the housing 420. The projection 421 may be compliantly resilient or flexible. The locking sleeve 440 can include an aperture 441. The aperture 441 can be sized to receive a protrusion 421 as shown in the transition from 9A to 9B. The sliding of the locking member 440 in a first direction can position the groove 441 over the protrusion 421. This can secure, at least temporarily or permanently, the locking sleeve 440 within the slot. In certain implementations maybe there is a hole in the top of the locking sleeve that provides access into the aperture for bending the projection 421 to release the locking member 440 from the projection 421 and slide back into the unlocked configuration.

Figure 9C:
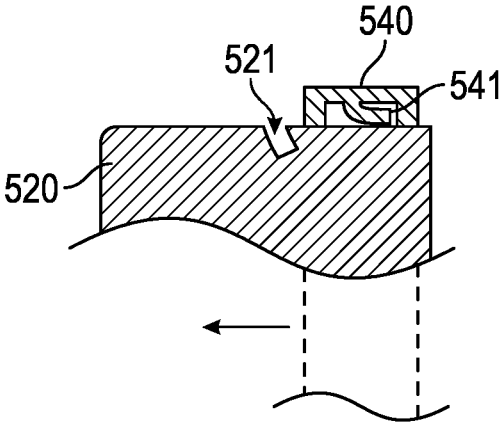
FIG. 9C shows a locking mechanism for securing the locking member in an unlocked configuration.
Figure 9D:
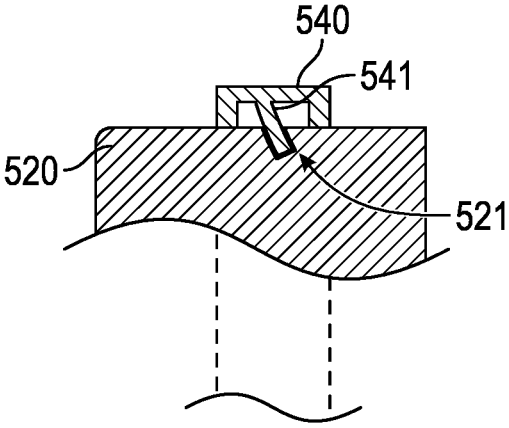
FIG. 9D shows the locking mechanism shown in FIG. 9C in a locked configuration.

FIGS. 9C and 9D show a second implementation of a locking mechanism for securing a locking member 540, like the member 140, with respect to a housing 520, like the housing 120. The locking member 540 can include a protrusion 521. The protrusion 521 may be a curved or projecting member extending outwardly from the locking member 540. The projection 521 may be compliantly resilient or flexible. The housing 520 can include an aperture 541. The aperture 541 can be sized to receive a protrusion 521 as shown in the transition from 9C to 9D. The sliding of the locking member 540 in the first direction can position the protrusion 521 in the groove 541. This can secure, at least temporarily or permanently, the locking sleeve 540 within the slot. In certain implementations maybe there is a hole in housing that provides access into the aperture for bending the projection 521 to release the projection 521 and slide the locking member 540 back into the unlocked configuration.

Certain Terminology

Terms of orientation used herein, such as "top," "bottom," "upper," "lower," "longitudinal," "lateral," "inner," "outer," and "end," are used in the context of the illustrated example. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain examples include or do not include, certain features, elements, and/or steps. Thus, such conditional language is not generally intended to imply that features, elements, and/or steps are in any way required for one or more examples.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain examples require the presence of at least one of X, at least one of Y, and at least one of Z.

The terms "approximately," "about," and "substantially" as used herein represent an amount close to the stated amount that still performs a desired function or achieves a desired result. For example, in some examples, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain examples, as the context may dictate, the term "generally parallel" can refer to something that departs from exactly parallel by less than or equal to 20 degrees. All ranges are inclusive of endpoints.

SUMMARY

Several illustrative examples of connectors have been disclosed. Although this disclosure has been described in terms of certain illustrative examples and uses, other examples and other uses, including examples and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various examples. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Further, while illustrative examples have been described, any examples having equivalent elements, modifications, omissions, and/or combinations are also within the scope of this disclosure. Moreover, although certain aspects, advantages, and novel features are described herein, not necessarily all such advantages may be achieved in accordance with any particular example. For example, some examples within the scope of this disclosure achieve one advantage, or a group of advantages, as taught herein without necessarily achieving other advantages taught or suggested herein. Further, some examples may achieve different advantages than those taught or suggested herein.

Some examples have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various examples can be used in all other examples set forth herein. Additionally, any methods described herein may be practiced using any device suitable for performing the recited steps.

For purposes of summarizing the disclosure, certain aspects, advantages and features of the inventions have been described herein. Not all, or any such advantages are necessarily achieved in accordance with any particular example of the inventions disclosed herein. No aspects of this disclosure are essential or indispensable. In many examples, the devices, systems, and methods may be configured differently than illustrated in the figures or description herein. For example, various functionalities provided by the illustrated modules can be combined, rearranged, added, or deleted. In some implementations, additional or different processors or modules may perform some or all of the functionalities described with reference to the examples described and illustrated in the figures. Many implementation variations are possible. Any of the features, structures, steps, or processes disclosed in this specification can be included in any example.

In summary, various examples of connectors have been disclosed. This disclosure extends beyond the specifically disclosed examples to other alternative examples and/or other uses of the examples, as well as to certain modifications and equivalents thereof. Moreover, this disclosure expressly contemplates that various features and aspects of the disclosed examples can be combined with, or substituted for, one another. Accordingly, the scope of this disclosure should not be limited by the particular disclosed examples described above, but should be determined only by a fair reading of the claims.

What is claimed is:

1. A connector, comprising:

a housing including a first portion, the first portion including:

a first opening and a second opening within the housing;

a positive terminal within the first opening including first and second paired jaw members with a first wire-receiving space therebetween; and a negative terminal within the second opening including third and fourth paired jaw members with a second wire-receiving space therebetween;

a locking sleeve coupled with the housing;

wherein in a first configuration, the first and second jaw members of the positive terminal are open to receive a first cable end within the first wire-receiving space and the third and fourth jaw members of the negative terminal are open to receive a second cable end within the second wire-receiving space;

wherein in a second configuration, the locking sleeve is in a locked position, the locking sleeve engaged with at least one of the first and second jaw members to close the first and second jaw members about the first cable end, and the locking sleeve engaged with at least one of the third and fourth jaw members to close the third and fourth jaw members about the second cable end such that the first and second cable ends are retained within the respective positive and negative terminals.

2. The connector of claim 1, wherein the first jaw member is a movable jaw member.

3. The connector of claim 2, wherein the second jaw member is a fixed jaw member.

4. The connector of claim 3, wherein the movable jaw member is pivotable about a first pin.

5. The connector of claim 3, wherein the movable jaw member is movable about a compliant portion thereof.

6. The connector of claim 3, wherein the movable jaw member is biased away from the second jaw member in an open configuration.

7. The connector of claim 6, wherein the movable jaw member is coupled with a spring member.

8. The connector of claim 3, wherein the locking sleeve includes a first wedge and a second wedge;

wherein in the locked position, the first wedge of the locking sleeve is engaged with the movable jaw member to close the first and second jaw members about the first cable end, and the second wedge of the locking sleeve is engaged with the at least one of the third and fourth jaw members to close the third and fourth jaw members about the second cable end.

9. The connector of claim 8, wherein the first and second wedges are independently actuatable.

10. The connector of claim 8, wherein the first wedge includes a first ramp surface aligned with the movable jaw member in a first direction, the locking sleeve configured to move from an unlocked position to the locked position in the first direction.

11. The connector of claim 10, wherein the first ramp surface has an angled profile.

12. The connector of claim 10, wherein the first ramp surface has a stepped profile.

13. The connector of claim 3, wherein the first jaw member and the second jaw member comprise a plurality of teeth.

14. The connector of claim 1, further comprising a locking mechanism configured to fix the locking sleeve in the locked position relative to the housing.

15. The connector of claim 14, wherein the locking mechanism includes a projection and an aperture, the aperture configured to receive the projection such that in the second configuration, the locking sleeve is in the locked position with the projection coupled within the aperture.

16. The connector of claim 15, wherein the projection is on the housing and the aperture is on the locking member.

17. The connector of claim 1, wherein the locking member includes a slide member, the first and second wedges positioned on the slide member.

18. The connector of claim 1, wherein the housing includes a second portion, the second portion including:

a positive contact conductively coupled with the positive terminal; and a negative contact conductively coupled with the negative terminal.

19. The connector of claim 18, wherein the positive contact comprises an outer cylindrical portion protruding from the housing and is coaxially mounted about an inner cylindrical portion of the negative contact.

20. The connector of claim 1, wherein the first wire-receiving space includes an inner transverse profile.

21. The connector of claim 20, wherein the inner transverse profile is cylindrical.

22. The connector of claim 20, wherein the inner transverse profile includes one or more transverse teeth extending into the first wire-receiving space.

23. The connector of claim 20, wherein the inner transverse profile includes one or more circumferential teeth extending into the first wire-receiving space.

24. The connector of claim 20, wherein the inner transverse profile is uniform from a front end to a second end of the first wire-receiving space.

25. An amplifier fast connector, comprising:

a housing including a first portion and a second portion, the first portion including:

a first opening within the housing, the first opening providing access to a positive terminal, the positive terminal including a first movable jaw member, a first fixed jaw member, and a first wire-receiving space between the first movable jaw member and the first fixed jaw member, the first movable jaw member biased away from the first fixed jaw member by a first elastic member; and a second opening within the housing, the second opening providing access to a negative terminal, the negative terminal including a second movable jaw member, a second fixed jaw member, and a second wire-receiving space between the second movable jaw member and the second fixed jaw member, the second movable jaw member biased away from the second fixed jaw member by a second elastic member;

the second portion including:

a positive contact conductively coupled with the positive terminal;

a negative contact conductively coupled with the negative terminal; and wherein the positive contact comprises an outer cylindrical portion protruding from the housing and coaxially mounted about an inner cylindrical portion of the negative contact, the inner cylindrical portion protruding from the housing;

a locking sleeve slideably disposed about the housing and movable in a first direction relative to the housing from an unlocked position to a locked position, the locking sleeve including:

a slide member;

a first wedge coupled with the slide member and including a first ramp surface aligned with the first movable jaw member in the first direction;

a second wedge coupled with the slide member and including a second ramp surface aligned with the second movable jaw member in the first direction; and a locking mechanism including a catch member on the housing and a slot on the locking sleeve, the slot configured to receive the catch member;

wherein in a first configuration, the locking sleeve is in an unlocked position and the first and second movable jaw members are open to each allow a cable end to be received through the respective first and second openings and into the respective first and second wire-receiving spaces;

wherein in a second configuration, the locking sleeve is in a locked position with the catch member coupled within the slot, the first wedge engaged with the first movable jaw member to close the first wire-receiving space, and the second wedge engaged with the second movable jaw member to close the second wire-receiving space such that the cable ends are retained within the respective positive and negative terminals.

* * * * *